US007360323B2

(12) United States Patent
Lee et al.

(10) Patent No.: US 7,360,323 B2
(45) Date of Patent: Apr. 22, 2008

(54) TOP FIREWALL COVER ASSEMBLY FOR LAUNDRY DRYER

(75) Inventors: Soon Jo Lee, Changwon-si (KR); Seong Hai Jeong, Changwon-si (KR)

(73) Assignee: LG Electronics Inc., Seoul (KR)

( * ) Notice: Subject to any disclaimer, the term of this patent is extended or adjusted under 35 U.S.C. 154(b) by 342 days.

(21) Appl. No.: 10/629,775

(22) Filed: Jul. 30, 2003

(65) Prior Publication Data

US 2004/0020073 A1 Feb. 5, 2004

(30) Foreign Application Priority Data

Jul. 31, 2002 (KR) ..... 10-2002-0045346

(51) Int. Cl.
*F26B 11/02* (2006.01)

(52) U.S. Cl. ..... 34/601

(58) Field of Classification Search ..... 34/595, 34/598, 600, 601

See application file for complete search history.

(56) References Cited

U.S. PATENT DOCUMENTS 1,550,700 A * 8/1925 Holub ..... 432/201
1,993,201 A * 3/1935 Yandell ..... 68/242
3,402,281 A * 9/1968 Vonderhaar ..... 219/408
4,051,858 A * 10/1977 Mele ..... 134/56 R
4,469,083 A * 9/1984 Helle et al. ..... 126/61
4,669,200 A * 6/1987 Carr ..... 34/242
4,840,285 A * 6/1989 Carr ..... 220/4.02
5,551,352 A 9/1996 Meier et al.
6,119,678 A * 9/2000 Marchand ..... 126/39 B

FOREIGN PATENT DOCUMENTS

JP 403191999 A * 12/1999
JP 2000-41653 * 2/2000
JP 2001212396 A 8/2001

* cited by examiner

*Primary Examiner*—Stephen Gravini
(74) *Attorney, Agent, or Firm*—McKenna Long & Aldridge LLP

(57) ABSTRACT

Top cover assembly including a top cover mounted on a side plate of a cabinet, a fire plate between the side plate and the top cover, for preventing spreading of fire taking place in the cabinet to an exterior, and a cabinet holder for fastening the fire plate to the side plate, thereby enhancing a sense of beauty in view of design and preventing spreading of fire taking place in the cabinet.

24 Claims, 6 Drawing Sheets

TOP FIREWALL COVER ASSEMBLY FOR LAUNDRY DRYER

This application claims the benefit of the Korean Application No. P2002-0045346 filed on Jul. 31, 2002, which is hereby incorporated by reference for all purposes as if fully set forth herein.

BACKGROUND OF THE INVENTION

1. Field of the Invention

The present invention relates to laundry dryers, and more particularly, to a top cover assembly for a laundry dryer.

2. Discussion of the Related Art

In general, a laundry dryer dries a wet washed object automatically. A system of the laundry dryer will be described, with reference to the attached drawings.

Referring to FIG. 1, a cabinet 'B', forming an exterior of the laundry dryer, is provided with a base 1, a front plate 2, a side plate 3, a back cover 4, and a top cover 5.

The base 1 and the back cover 4 form a bottom surface and a rear surface of the cabinet 'B', and the front plate 2 and the side plate 3 form a front surface and a side surface. The top cover 5, mounted above the front plate 2, the side plate 3, and the back cover 4, forms a top surface of the cabinet 'B'. There are a control panel 6 on the top cover 5 for user's operation, and a door 7 in the front plate 2 for prevention of escape of drying object, such as laundry.

In addition, there is a drying drum (not shown) in the cabinet 'B' to be rotatable by a rotation power from a motor (not shown). Air heated by a heater (not shown) is forcibly introduced into the drying drum, for drying the laundry and the like in the drying drum.

The base 1, the front plate 2, the side plate 3, the back cover 4, and the top cover 5 of the cabinet 'B' are formed of steel plate in the event of a fire taking place in the cabinet 'B' caused by foreign matters such as fluff, or an electrical short at a contact. That is, the top cover 5 and the like are formed of steel plate for preventing a fire taking place in the cabinet 'B' from spreading to an exterior.

However, the related art laundry dryer has the following problems caused by the steel construction.

At first, the related art top cover is fabricated by pressing the steel plate and painting an outside surface thereof. Therefore, the related art top cover having a simple flat surface has a poor aesthetic quality from a design standpoint.

Moreover, even if the top cover is curved for better design, the top cover of steel plate shows wrinkles on its periphery.

In conclusion, the related art top cover 5 has a structure that is difficult to curve despite not being exposed to danger of fire.

SUMMARY OF THE INVENTION

Accordingly, the present invention is directed to a top cover assembly for a laundry dryer that substantially obviates one or more of the problems due to limitations and disadvantages of the related art.

An advantage of the present invention is to provide a top cover assembly for a laundry dryer, that separates the top cover from the fire resistant housing, thereby allowing for a greater variety of materials and designs to be used on the top surface whicle still preventing fire taking place in the laundry dryer from spreading to the exterior.

Additional features and advantages of the invention will be set forth in the description which follows, and in part will be apparent from the description, or may be learned from practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the top cover assembly includes a top cover mounted on a side plate of a cabinet, a fire plate between the side plate and the top cover, for preventing the spreading of fire taking place in the cabinet to an exterior, and a cabinet holder for fastening the fire plate to the side plate.

The top cover is formed of plastic, and includes a curved top surface. The fire plate includes a top surface having a curve the same with the top cover.

The cabinet holder and the fire plate include an outside surface mounted to be in contact with an inside surface of the top cover for serving as a supporting wall which prevents the side surface of the top cover pushed inward by an external force. The fire plate includes grooves in a center part for improving a rigidity of the fire plate.

The cabinet holder includes a plurality of fastening pieces formed on an underside of the cabinet holder for fastening the fire plate to the side plate. In this instance, the fire plate includes a first flange at each of opposite edges having a plurality of first fastening holes for inserting the fastening pieces, and the side plate includes a second flange in top part having a plurality of second fastening holes in communication with the first fastening holes.

The cabinet holder further includes a plurality of through holes in communication with the first, and second holes, and the fastening piece is formed on an underside of an edge of one side of the through hole.

The second flange further includes a plurality of positioning projections projected upward for alignment of a fastening position of the side plate with the fire plate, and the first flange further includes first inserting holes for inserting the positioning projections therein.

The cabinet holder may further include a plurality of second inserting holes for inserting the positioning projections projected through the first inserting holes. The positioning projections are formed by lancing, and the fire plate includes grooves in a center part of a top surface for improving a rigidity of the fire plate.

The cabinet holder and the fire plate include outside surfaces mounted to be in contact with an inside surface of the top cover for serving as a supporting wall which prevents the side surface of the top cover pushed inward by an external force.

In another aspect of the present invention, there is provided a laundry dryer including a side plate and a front plate of a cabinet, a door in a front surface of the front plate, a top cover on top of the side plate and the front plate, a control panel on the top cover, a fire plate between the side plate and the front plate and the top cover for preventing spreading of fire taking place in the cabinet, and a cabinet holder for joining the fire plate to the side plate.

The laundry dryer further includes a cabinet bracket on each of top corners of the laundry dryer where the front plate and the side plate are joined, for joining with opposite ends of the front plate and the side plate.

The cabinet bracket includes a hook fastener on top thereof, and the top cover includes a hook for fastening to the hook fastener.

It is to be understood that both the foregoing description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principle of the invention.

In the drawings.

DETAILED DESCRIPTION OF THE ILLUSTRATED EMBODIMENTS

Reference will now be made in detail to an embodiment of the present invention, example of which is illustrated in the accompanying drawings.

Figure 1:
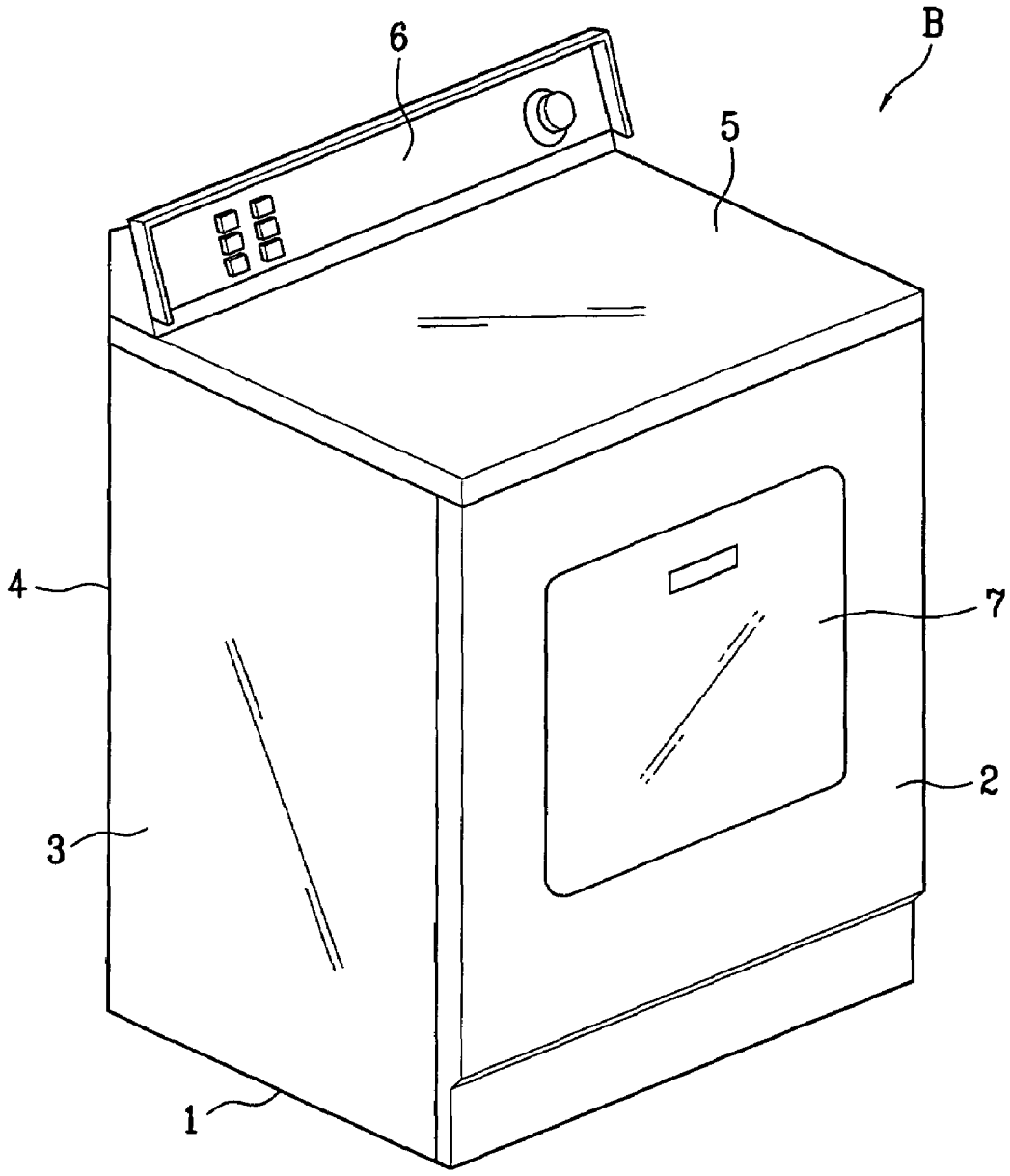
FIG.1 Related Art
FIG. 1 illustrates a perspective view showing an outside shape of a related art laundry dryer.
Figure 2:
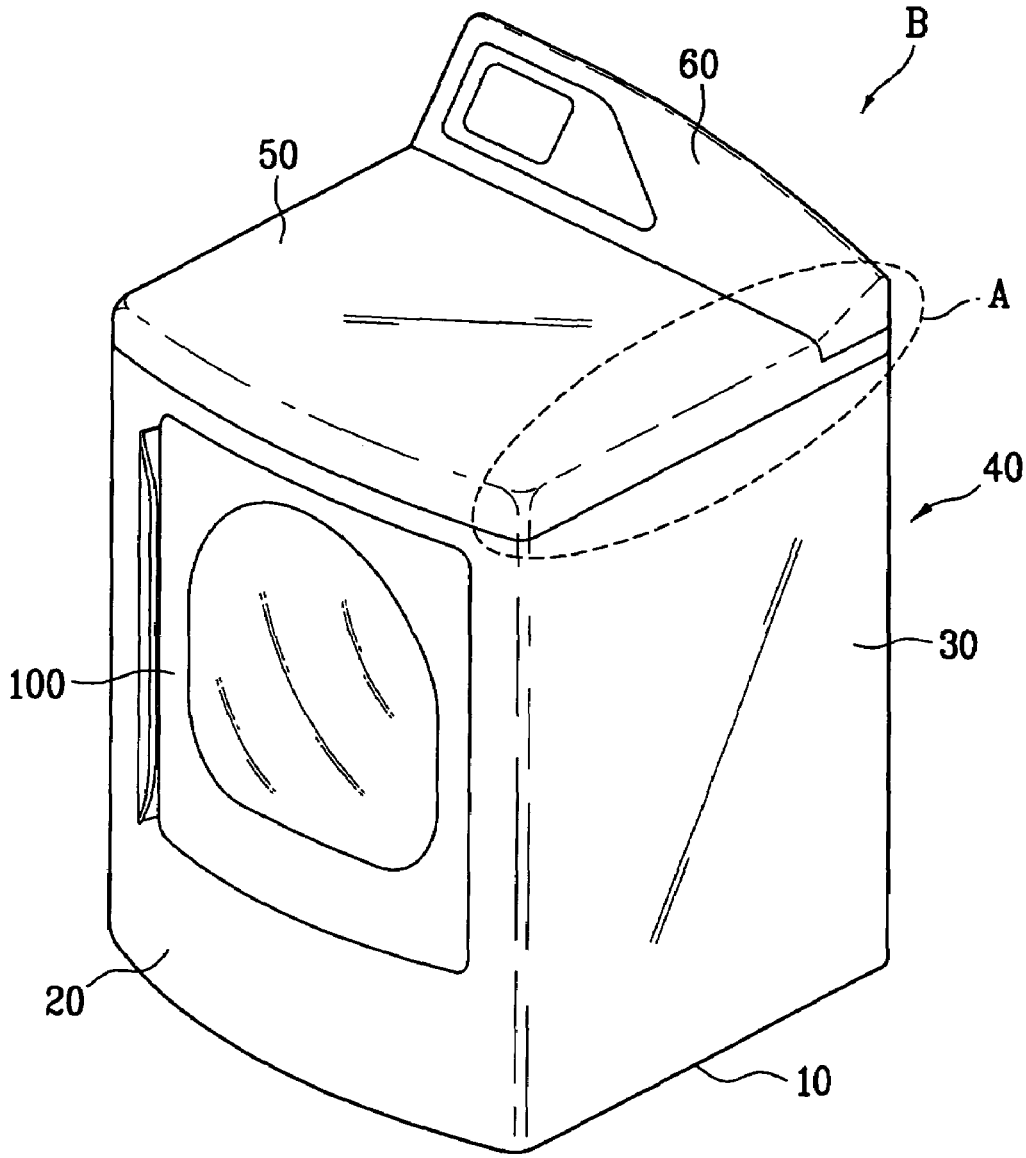
FIG. 2 illustrates a perspective view showing an outside shape of a laundry dryer in accordance with an embodiment of the present invention.

An outside shape of the laundry dryer of the present invention will be described. Referring to FIG. 2, the laundry dryer has a front plate 20 forming a front of the cabinet 'B', and a side plate 30 and a back cover 40 forming a side and a rear of the cabinet 'B'. There are a base 10 below the plates 20 and 30 and the back cover 40, to form a bottom of the cabinet 'B', and a top cover 50 at a top thereof.

There are a control panel 60 on the top cover 50 for user's operation, and a door 100 in the front plate 20. The door permits the user to introduce or take out laundry into/from the cabinet "B".

Different from the related art top cover 5, the top cover 50 of the present invention is fabricated to have a curved top edge. For this, it is preferable that the top cover 50 is formed of plastic. The fabrication of the top cover 50 of plastic is easier than the same of steel plate in forming, and able to prevent wrinkle formation in the periphery following curving. Of course, the top cover 50 may be fabricated of a steel plate the same as with the related art for better strength. Moreover, the top cover 50 may have a simple curve, or another desired form of top surface.

An inside structure, particularly a top cover 50 assembly structure of the laundry dryer of the present invention, will be described in detail.

Figure 3:
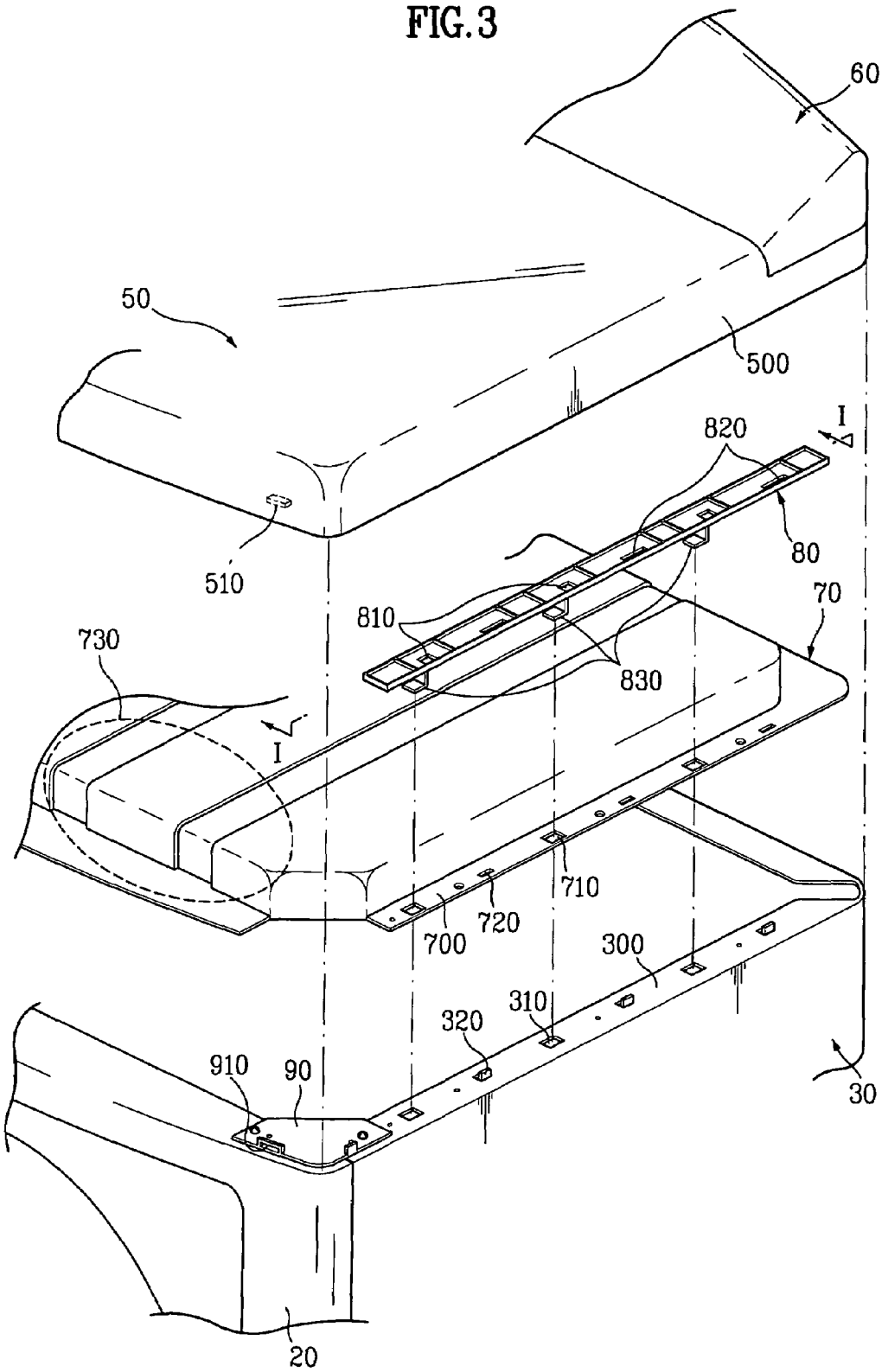
FIG. 3 illustrates a disassembled perspective view of "A" part in FIG. 2 for describing a top cover assembly for a laundry dryer in accordance with an embodiment of the present invention.

Referring to FIG. 3, the top cover 50 assembly for a laundry dryer of the present invention includes a top cover 50, a fire plate 70, and a cabinet holder 80.

As described, the top cover 50, formed of plastic, can have a variety of forms, such that a top surface thereof is curved, and the like. The fire plate is under the top cover 50, for preventing spreading of fire taking place in the cabinet 'B'. To do this, the fire plate 70 is formed of a fire proofing material, and preferably of metal, such as steel plate, taking strength, and the like, into account.

A top surface of the fire plate 70 may be formed to have a curvature similar to the top surface of the top cover 50. The fire plate 70 may have grooves 730 in a center part of top surface additionally for enhancing a rigidity of the fire plate 70. The fire plate 70 is joined with a side plate 30 forming a side of the cabinet 'B' with the cabinet holder 80.

The cabinet holder 80 is provided on the fire plate 70 and has a plurality of fastening pieces 830 each bent down from the cabinet holder 80 for joining the fire plate 70 with the side plate 80. Referring to FIG. 3, even though the cabinet holder 80 has a form of a bar, it is apparent that, even if there is no further description, the form of the cabinet holder 80 is not limited to this, but may have a variety of forms.

The fire plate 70 has a first flange 700 at each of opposite edges for joining the cabinet holder 80. The first flange 700 has a plurality of fastening holes 710 for inserting the fastening pieces 830 on the cabinet holder 80.

On the other hand, there is a second flange 300 in top part of the side plate 30 for seating the first flange on the fire plate 70. The second flange 300 has second fastening holes 310 in communication with the first fastening holes 710. Thus, the fastening pieces 830 are respectively inserted into the first and second fastening holes 710 and 310 on the flanges 300 and 700, for joining the fire plate 70 with the side plate 30.

The second flange 300 may have a plurality of positioning projections 320 further. The positioning projections 320 are upward projections from the second flange 300 for alignment of the side plate 30 with the fire plate 70, for which the fire plate 70 has a plurality of inserting holes 720 in the first flange 700 for inserting the positioning projections 320.

That is, the positioning projections 320 are inserted in the first inserting holes 720 in assembly for an exact alignment of the side plate 30 and the fire plate 70. The positioning projections are formed by lancing parts of the second flange 300. The lancing, a kind of sheet metal working, cuts and bends a part of the sheet metal with a press mold in one stroke.

In addition, the cabinet holder 80 may further have second inserting holes 820 in communication with the first inserting holes 720. This is because the projection of the positioning projections 320 above the first flange 700 through the first inserting holes 720 makes the assembly difficult. Therefore, if the height of the positioning projections 320 are adjusted so as not to be projected above the first inserting holes 720, no second inserting holes 820 are required.

Moreover, the cabinet holder 80 may further have a plurality of through holes 810 in communication with the first and second fastening holes 710 and 310. The through holes 810, formed for making an exact joining of the fastening pieces 830 with the fire plate 70 and the side plate 30 sure, will be described in description of a top cover 50 joining given later in more detail. When the cabinet holder 80 has through holes, each of the fastening pieces 830 is formed on an underside of an edge of one side of each of the through holes 810.

In addition, there is a cabinet bracket 90 on top of each corner of the cabinet where the side plate 30 and the front plate 20 are joined. The bracket 90 is fastened to ends of the plates 20 and 30 with screws, or the like, for joining the plates 20 and 30.

The cabinet bracket 90 is also fastened to the top cover 50. For this, the cabinet bracket 90 has a hook fastener 910, and the top cover 50 has a hook 510 on an inside surface to be held at the hook fastener 910. As shown in the drawing, the hook fastener 910 may be formed on a top surface of the front plate 20, or the side plate 30.

A process for assembling the top cover 50 of the laundry dryer of the present invention will be described.

Figure 4A:
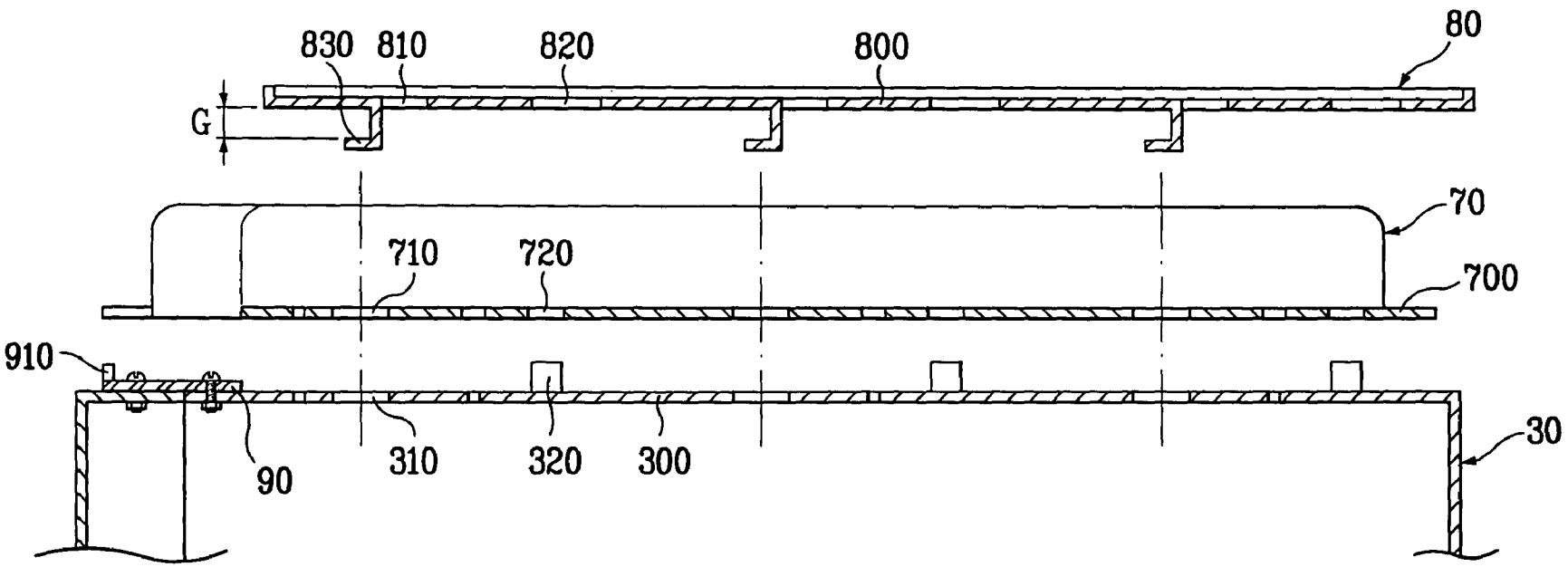
FIG. 4A illustrates a section across a line I-I in FIG. 3 showing a state before a cabinet holder fastens the fire plate to a side plate.
Figure 4B:
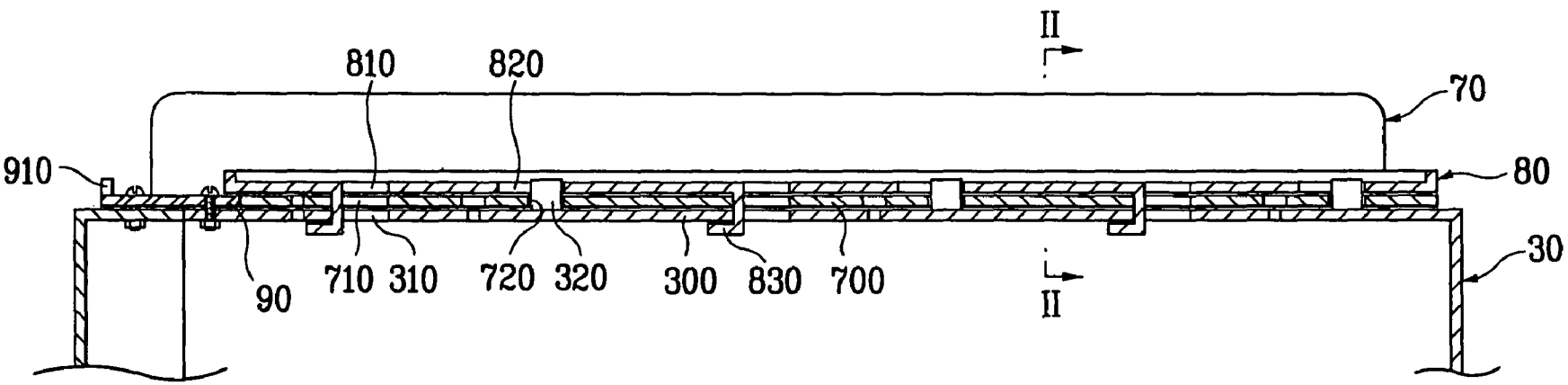
FIG. 4B illustrates a section showing a state after the fastening in FIG. 4A.

Referring to FIGS. 4A and 4B, the fire plate 70 is aligned with the side plate 30 by means of the positioning pieces 320 and the first inserting holes 720. Then, the fire plate 70 is placed on the side plate 30 such that the first flange 700 of the fire plate 70 abuts the second flange 300 of the side plate 30.

In this instance, the positioning piece 320 is positioned to pass through the first inserting hole. In general, since numbers of the positioning pieces 320 and the first inserting holes 720 are equal, every one positioning piece 320 is inserted in every one first inserting hole 720. Therefore, if either the positioning piece 320 or the first inserting hole 720 is in surplus or is missing, it means that the fire plate 70 is misaligned and re-alignment of the fire plate 70 is required.

Once the fire plate 70 is placed on the side plate 30, the first fastening holes 710 in the fire plate 70 and the second fastening holes 310 in the side plate 30 are also aligned (abuts). Then, the fastening pieces 830 on the cabinet holder 80 are inserted into the aligned first and second fastening holes 710 and 310.

If there are the second inserting holes 820 in the cabinet holder 80 for preventing interference between the positioning pieces 320 and the cabinet holder 80, the positioning pieces 320 are positioned to pass through the first and second inserting holes 720 and 820. Then, when the cabinet holder 80 is pushed in the front plate direction 20, the fire plate 70 and the side plate 30 are inserted between the gaps G in the fastening pieces 830, to join the fire plate 70 with the side plate 30. The pushing direction of the cabinet holder 80 is related with a forming direction of the fastening pieces 830. Accordingly, if the fastening pieces 830 are formed opposite to the drawing, it is required to push the cabinet holder 80 in a direction of the back cover 40 in the joining.

The second inserting hole 820 is formed greater than the first inserting hole 720 because the cabinet holder 80 moves during assembly or disassembly. That is, as described, for joining the fire plate 70 with the side plate 30 with the fastening pieces 830, it is required to push the cabinet holder 80 forward. Therefore, if the second inserting hole 820 is short, the cabinet holder 80 cannot move due to the positioning pieces 320 that are positioned passed through the second inserting holes 820, which is the same in disassembly.

Furthermore, if there are through holes 810 in the cabinet holder 80, each of the fastening pieces 830 is formed on an underside of an edge of a side of each of the through holes 810. The through holes 810 are formed for making an exact fastening of the fastening pieces 830 with the fire plate 70 and the side plate 30 sure. That is, an exact gripping on the fire plate 70 and the side plate 30 by the fastening pieces 830 is made sure. As shown in FIG. 4B, in a case the through holes 810 are formed at a size the same with the first or second fastening hole 710 or 310, if the through holes 810 are aligned with the first and second fastening holes 710 and 310, it means that the joining is completed.

Figure 5:
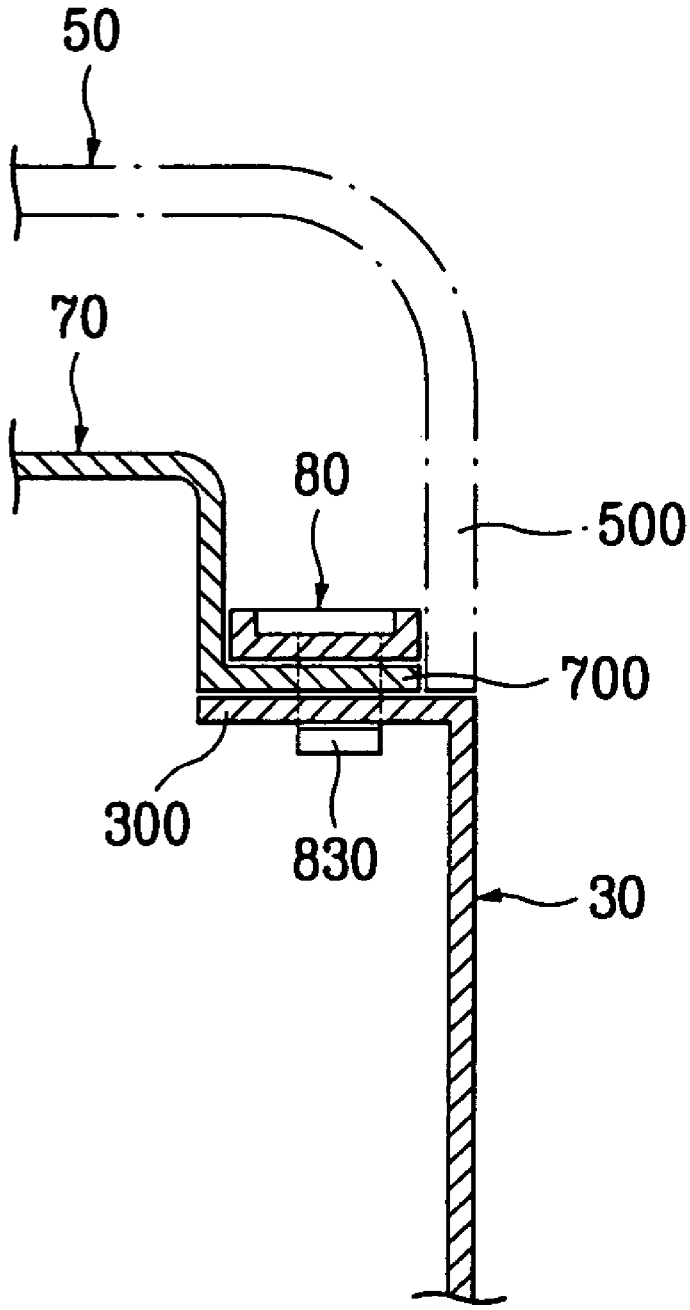
FIG. 5 illustrates a section across a line II-II in FIG. 4B.

As shown in FIG. 5, after the joining of the fire plate 70 and the side plate 30 with the cabinet holder 80 is finished, the top cover 50 is placed on, and joined with the side plate 30. The joining of the top cover 50 is done when the hooks 510 on the top cover 50 are fastened to the hook fasteners 910 on the cabinet bracket 90. Of course, for firmer fastening, the top cover 50 may be fastened to the back cover 40 with screws, additionally.

When the assembly is finished thus, the fire plate 70, the cabinet holder 80 and the top cover 50 are positioned on the second flange 300 of the side plate 30. The fire plate 70 is positioned inside of top of the second flange 300, and the top cover 50 is positioned outside of top of the second flange 300, with the cabinet holder 80 arranged in between.

In this instance, it is preferable that edges of the cabinet holder 80 and the fire plate 70 are in contact with an inside surface of the top cover 50. According to this, the top cover 50, having a side supported on the outside of the cabinet holder 80 and the first flange 700, is not pushed in. That is, the cabinet holder 80 both fastens the fire plate 70 to the side plate 30, and serves as a supporting wall which prevents the side of the top cover 50 from being pushed inward into the cabinet 'B' when an external force is applied to the side of the top cover 50.

The top surface of the top cover 5 is curved, and the fire plate 70 is also fabricated to follow the curve of the top cover 50. Accordingly, even if the fire plate 70 of metal has a wrinkled part due to the curving, the curve of the fire plate 70 does not affect the visual design because the fire plate 70 is covered with the top cover 50.

The fire plate 70 may have grooves 730 in a center part of top surface in front and rear direction additionally for enhancing a rigidity of the fire plate 70.

A top cover 50 assembly for a laundry dryer is discussed up to now. However, because drum type washing machines used currently can also serve as laundry dryers, the top cover assembly is applicable to the drum type washing machine, too.

The top cover assembly for a laundry dryer of the present invention has the following advantages.

A fire safety can be secured, and the visual appearance of the product can be enhanced in view of design. That is, by providing a curved top cover, the sense of beauty of the product can be enhanced in view of design. Also, by preventing spreading of a fire taking place in the product to an exterior, a laundry dryer which can secure safety from fire can be provided.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A laundry dryer top cover assembly comprising:

a top cover mounted on a side plate of a cabinet;

a fire plate disposed between the side plate and the top cover for preventing fire from spreading outside the laundry dryer; and a cabinet holder configured to fasten the fire plate to the side plate wherein the cabinet holder includes a plurality of fastening pieces configured for insertion into the fire plate and the side plate.

2. The top cover assembly as claimed in claim 1, wherein the top cover is plastic.

3. The top cover assembly as claimed in claim 1, wherein the top cover includes a curved top surface.

4. The top cover assembly as claimed in claim 1, wherein the fire plate includes a top surface having a curvature matching a curvature of the top cover.

5. The top cover assembly as claimed in claim 1, wherein the cabinet holder and the fire plate include sides mounted in contact with an inside surface of the top cover, said sides serving as a supporting wall which prevents the side surface of the top cover from inward deformation by an external force.

6. The top cover assembly as claimed in claim 1, wherein the fire plate includes grooves in a center part of a top surface for improving a rigidity of the fire plate.

7. The top cover assembly as claimed in claim 1, wherein the cabinet holder includes a plurality of fastening pieces on an underside of the cabinet holder for fastening the fire plate to the side plate.

8. The top cover assembly as claimed in claim 7, wherein the fire plate includes a first flange at each of opposite edges having a plurality of first fastening holes receiving the fastening pieces; and the side plate includes a second flange in top part having a plurality of second fastening holes in communication with the first fastening holes.

9. The top cover assembly as claimed in claim 8, wherein the cabinet holder further includes a plurality of through holes in communication with the first, and second holes; and at least one of said fastening pieces is on an underside of an edge of one side of the through hole.

10. The top cover assembly as claimed in claim 8, wherein the second flange further includes a plurality of positioning projections projected upward for alignment of a fastening position of the side plate with the fire plate; and the first flange further includes first inserting holes receiving the positioning projections therein.

11. The top cover assembly as claimed in claim 10, wherein the cabinet holder further includes a plurality of second inserting holes receiving the positioning projections projected through the first inserting holes.

12. The top cover assembly as claimed in claim 10, wherein the positioning projections are formed by lancing.

13. The top cover assembly as claimed in claim 8, wherein the fire plate includes grooves in a center part of a top surface for improving a rigidity of the fire plate.

14. The top cover assembly as claimed in claim 8, wherein the cabinet holder and the fire plate include sides mounted in contact with an inside surface of the top cover, said sides serving as a supporting wall which prevents the side surface of the top cover from inward deformation by an external force.

15. A laundry dryer comprising:

a side plate and a front plate of a cabinet;

a door in a front surface of the front plate;

a top cover on top of the side plate and the front plate;

a control panel on the top cover;

a fire plate between the side plate and the top cover and between the front plate and the top cover, the fire plate having a first flange with a plurality of first fastening holes; and a cabinet holder joining the fire plate to the side plate, the cabinet holder including a plurality of fastening pieces on an underside of the cabinet holder wherein the plurality of first fastening holes receive the plurality of fastening pieces.

16. The laundry dryer as claimed in claim 15, further comprising a cabinet bracket on each of top corners of the laundry dryer where the front plate and the side plate are joined, for joining with opposite ends of the front plate and the side plate.

17. The laundry dryer as claimed in claim 16, wherein the cabinet bracket includes a hook fastener on top thereof, and the top cover includes a hook for fastening to the hook fastener.

18. The laundry dryer as claimed in claim 15, wherein the top cover is formed of plastic.

19. The laundry dryer as claimed in claim 15, wherein the top cover includes a curved edge.

20. The laundry dryer as claimed in claim 15, wherein the fire plate includes a top surface having a curvature matching a curvature of the top cover.

21. The laundry dryer as claimed in claim 15, wherein the cabinet holder includes a plurality of fastening pieces on an underside of the cabinet holder fastening the fire plate to the side plate, wherein the first flange is at an edge of the fire plate and the side plate includes a second flange at a top part having a plurality of second fastening holes in communication with the plurality of first fastening holes.

22. The laundry dryer as claimed in claim 21, wherein the cabinet holder further includes a plurality of through holes in communication with the first, and second fastening holes;

and the fastening pieces are on an underside of an edge of one side of the through hole.

23. The laundry dryer as claimed in claim 21, wherein the second flange further includes a plurality of positioning projections projected upward for aligning the side plate during fastening of the side plate with the fire plate; and the first flange further includes first inserting holes receiving the positioning projections therein.

24. The laundry dryer as claimed in claim 23, wherein the cabinet holder further includes a plurality of second inserting holes receiving the positioning projections projected through the first inserting holes.

* * * * *